US009470042B2

(12) United States Patent
Snyder et al.

(10) Patent No.: US 9,470,042 B2
(45) Date of Patent: Oct. 18, 2016

(54) DOWN HOLE HARMONIC DRIVE TRANSMISSION

(71) Applicant: HALLIBURTON ENERGY SERVICES, INC., Houston, TX (US)

(72) Inventors: John Kenneth Snyder, Spring, TX (US); Richard Thomas Hay, Spring, TX (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 79 days.

(21) Appl. No.: 14/387,499

(22) PCT Filed: Nov. 22, 2013

(86) PCT No.: PCT/US2013/071471

§ 371 (c)(1),
(2) Date: Sep. 23, 2014

(87) PCT Pub. No.: WO2015/076826

PCT Pub. Date: May 28, 2015

(65) Prior Publication Data

US 2015/0376948 A1 Dec. 31, 2015

(51) Int. Cl.

| | |
|---|---|
| ***E21B 4/02*** | (2006.01) |
| ***E21B 4/00*** | (2006.01) |
| ***E21B 3/00*** | (2006.01) |

(52) U.S. Cl.

CPC ..... *E21B 4/006* (2013.01); *E21B 3/00* (2013.01); *E21B 4/02* (2013.01)

(58) Field of Classification Search

CPC ..... E21B 4/02; E21B 4/003; F16H 49/001
See application file for complete search history.

(56) References Cited

U.S. PATENT DOCUMENTS

| | | | | |
|---|---|---|---|---|
| 2,906,143 A | | 9/1959 | Musser | |
| 3,021,910 A | * | 2/1962 | Martin | 175/25 |
| 4,491,186 A | | 1/1985 | Alder | |
| 4,663,813 A | | 5/1987 | Carlson | |
| 4,715,469 A | | 12/1987 | Yasuda et al. | |

(Continued)

FOREIGN PATENT DOCUMENTS

| | | | |
|---|---|---|---|
| CA | 1257865 A | * | 7/1989 |
| CN | 2126307 | | 12/1992 |

(Continued)

OTHER PUBLICATIONS

International Search Report and Written Opinion of the International Searching Authority issued in International Application No. PCT/US2013/071471 on Aug. 21, 2014; 14 pages.

(Continued)

*Primary Examiner* — Kipp Wallace
(74) *Attorney, Agent, or Firm* — Alan Bryson; Parker Justiss, P.C.

(57) ABSTRACT

A drilling assembly positionable in a well bore includes a turbine motor couplable to a drill string and a harmonic drive transmission coupled to the turbine motor. The harmonic drive transmission includes a circular spline, a wave generator, a flexspline, and a sealing subsystem. The sealing subsystem defines a substantially sealed volume containing the circular spline, wave generator, and flexspline, and isolates the circular spline, wave generator, and flexspline from drilling fluid exiting the turbine motor and flowing through the harmonic drive transmission.

23 Claims, 5 Drawing Sheets

(56) References Cited

U.S. PATENT DOCUMENTS

| | | | | |
|---|---|---|---|---|
| 4,909,098 | A | 3/1990 | Kiryu | |
| 5,070,944 | A | 12/1991 | Hopper | |
| 5,282,398 | A | 2/1994 | Ishikawa | |
| 5,316,090 | A | 5/1994 | Kuwana et al. | |
| 5,353,884 | A | 10/1994 | Misawa et al. | |
| 5,875,859 | A | 3/1999 | Ikeda et al. | |
| 6,059,661 | A * | 5/2000 | Simpson | E21B 7/067 464/178 |
| 6,273,189 | B1 | 8/2001 | Gissler et al. | |
| 6,336,502 | B1 * | 1/2002 | Surjaatmadja et al. | 166/104 |
| 6,629,571 | B1 | 10/2003 | Downie | |
| 6,722,442 | B2 | 4/2004 | Simpson | |
| 7,204,314 | B2 | 4/2007 | Lauritzen et al. | |
| 7,802,638 | B2 | 9/2010 | Downie et al. | |
| 2004/0055404 | A1 * | 3/2004 | Mills | F16H 63/18 74/337.5 |
| 2005/0029016 | A1 * | 2/2005 | Self | E21B 7/046 175/74 |
| 2008/0142264 | A1 | 6/2008 | Hall et al. | |
| 2010/0212965 | A1 | 8/2010 | Hall et al. | |
| 2011/0100715 | A1 | 5/2011 | Kolle et al. | |
| 2012/0318495 | A1 | 12/2012 | Crow et al. | |
| 2016/0024848 | A1 * | 1/2016 | Desmette | E21B 7/067 175/74 |

FOREIGN PATENT DOCUMENTS

| | | |
|---|---|---|
| CN | 201650259 | 11/2010 |
| DE | 4231025 | 3/1994 |
| RU | 2456425 | 7/2012 |
| WO | WO 98/20228 | 5/1998 |
| WO | WO 2011/096842 | 8/2011 |

OTHER PUBLICATIONS

Halliburton, "Turbopower™ Turbodrills," H08580-A4, Feb. 2013, 4 pages.

Schlumberger, "Neyrfor Turbodrills," 11-SH-0022, 2011, 6 pages.

* cited by examiner

DOWN HOLE HARMONIC DRIVE TRANSMISSION

CLAIM OF PRIORITY

This application is a U.S. National Stage of International Application No. PCT/US2013/071471, filed Nov. 22, 2013.

TECHNICAL FIELD

The present disclosure relates to systems, assemblies, and methods relating to harmonic drive transmissions for use in a down hole drilling environment.

BACKGROUND

In connection with the recovery of hydrocarbons from the earth, wellbores are generally drilled using a variety of different methods and equipment. According to one common method, a roller cone bit or fixed cutter bit is rotated against the subsurface formation to form the well bore. In some implementations, the drill bit is rotated in the wellbore via rotary force provided by a subsurface turbine motor powered by a flow of drilling fluid circulating through a supporting drill string. The turbine motor produces high speed, low torque rotary motion applied to a motor shaft. In some cases (e.g., when drilling especially plasticizable clays and other relatively "soft" formation), the high speed, low torque turbine motor output facilitates less than optimal drilling operations. One way to avoid this type of suboptimal drilling condition is to convert the high speed, low torque output from the turbine motor into low speed, high torque rotary motion. In the past, there have been attempts to employ planetary gear systems for this purpose. Occasionally with planetary gear transmissions, in the process of effecting the torque conversion, the load-carrying shaft diameters get too small for the torque load required.

DETAILED DESCRIPTION

Figure 1:
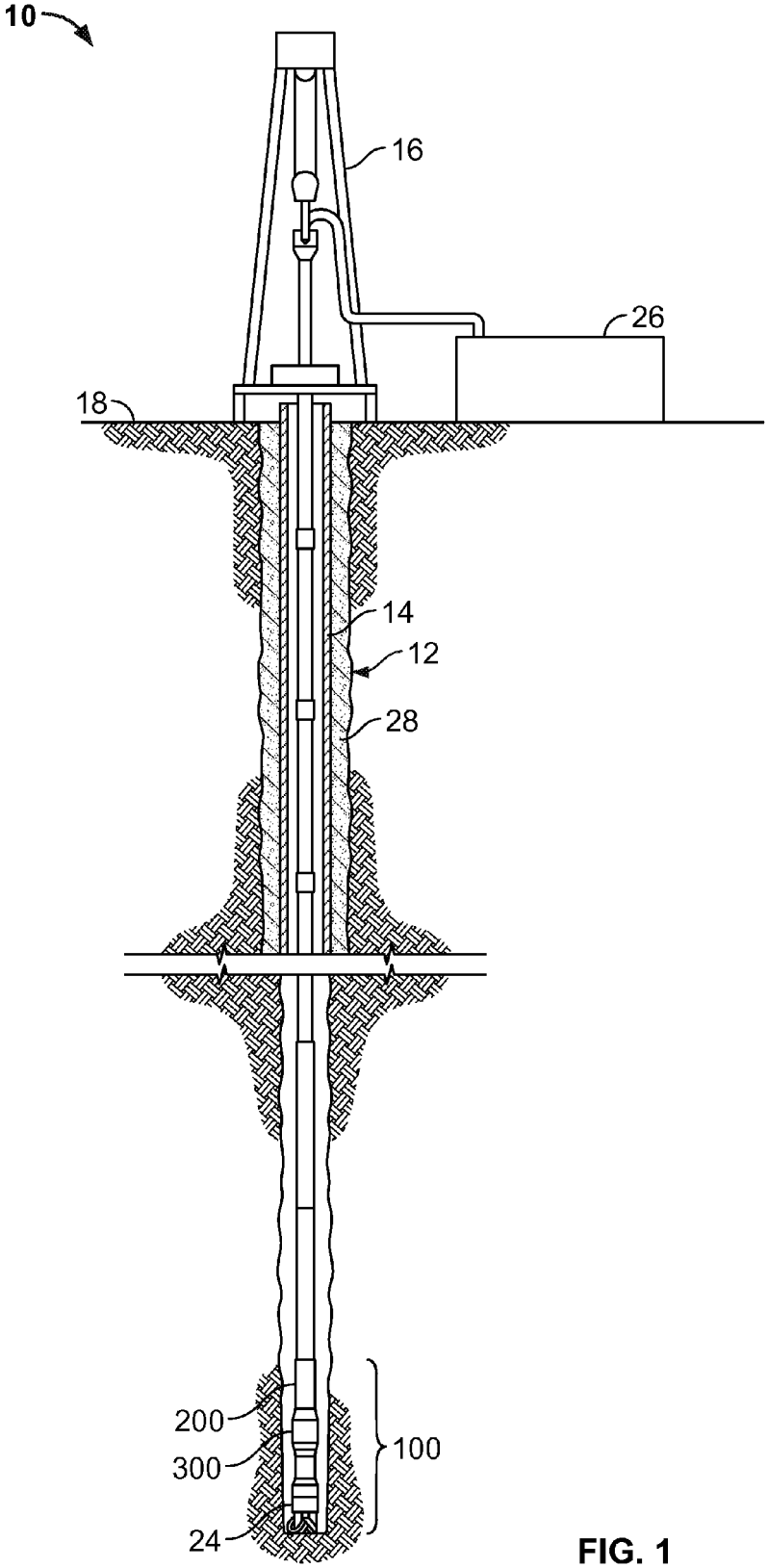
FIG. 1 is a schematic illustration of a drilling rig including a bottom hole assembly equipped with a subsurface drilling motor and transmission.

FIG. 1 is a diagram of an example drilling rig 10 for drilling a well bore 12. The drilling rig 10 includes a drill string 14 supported by a derrick 16 positioned generally on an earth surface 18. The drill string 14 extends from the derrick 16 into the well bore 12. A bottom hole assembly 100 at the lower end portion of the drill string 14 includes a subsurface drilling motor 200, a harmonic drive transmission 300, and a drill bit 24. The drill bit 24 can be a fixed cutter bit, a roller cone bit, or any other type of bit suitable for drilling a well bore. A drilling fluid supply system 26 circulates drilling fluid (often called "drilling mud") down through a bore of the drill string 14 to the subsurface drilling motor 200. The drilling fluid is discharged through or near the drill bit 24 to assist in the drilling operations, and subsequently routed back toward the surface 18 through an annulus 28 formed between the well bore 12 and the drill string 14.

In this example, the subsurface drilling motor 200 is a turbine down hole motor including a set of turbine blades/vanes arranged to convert kinetic energy from the incoming drilling fluid into power for rotating a motor shaft. The subsurface drilling motor spins the motor shaft at relatively high rotational speed and relatively low torque. As described herein, the motor shaft of the subsurface drilling motor is operatively coupled to a harmonic drive transmission. In this example, the harmonic drive transmission is designed to convert the high speed, low torque rotation of the motor shaft into a high torque, low speed output. Thus, the harmonic drive transmission is said to produce a "step down" in rotational speed. In some other examples, the harmonic drive transmission can be designed to convert low speed, high torque rotation into low torque, high speed output. This type of harmonic drive transmission is said to produce a "step up" in rotational speed. One purpose of the harmonic drive transmission is to provide the drill bit with an appropriate characteristic of rotation for effective drilling operations. Various drill bits may be designed to operate within a rotary speed range of about 100 to 1,000 RPM. A turbine motor (as well as some other types of down hole motors) is produces much higher rotational speeds (e.g., 3,000 RPM), and therefore a step down harmonic drive transmission can be used to achieve the desired rotary speed at the drill bit. As discussed in detail below, a multi-stage or "stack" of two or more harmonic drive transmissions can be designed to achieve the desired rotational speed output for a particular bit.

In the foregoing description of the drilling rig 10, various items of equipment, such as pipes, valves, pumps, fasteners, fittings, etc., may have been omitted to simplify the description. However, those skilled in the art will realize that such conventional equipment can be employed as desired. Those skilled in the art will further appreciate that various components described are recited as illustrative for contextual purposes and do not limit the scope of this disclosure. Further, while the drilling rig 10, is shown in an arrangement that facilitates straight down hole drilling, it will be appreciated that directional drilling arrangements are also contemplated and therefore are within the scope of the present disclosure.

Figure 2:
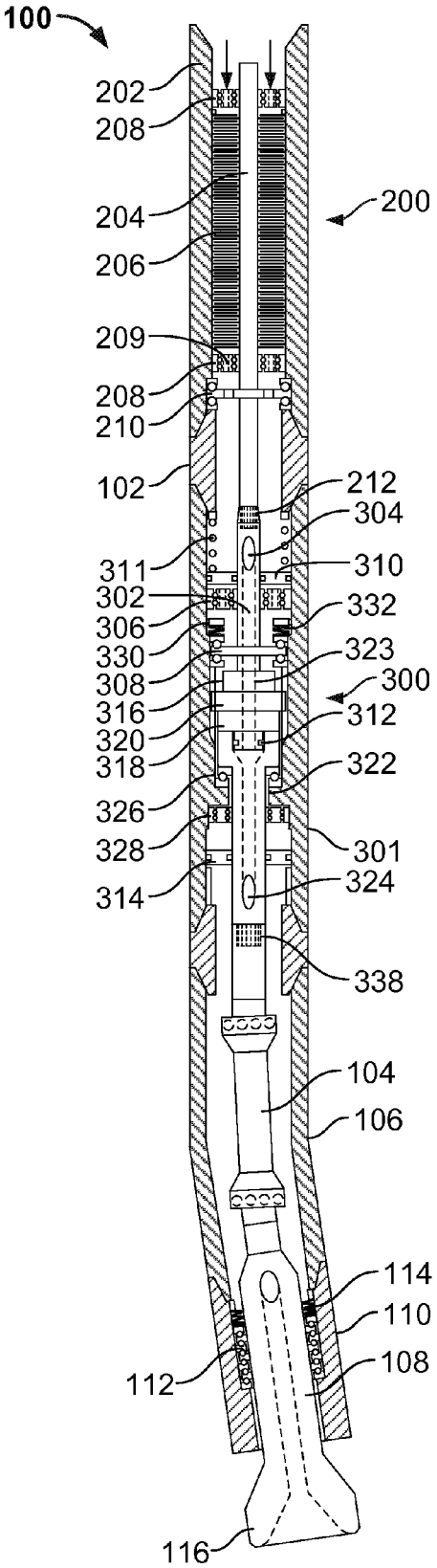
FIG. 2 is a cross-sectional side view of an example bottom hole assembly featuring a drilling motor coupled to a harmonic drive transmission.
Figure 4:
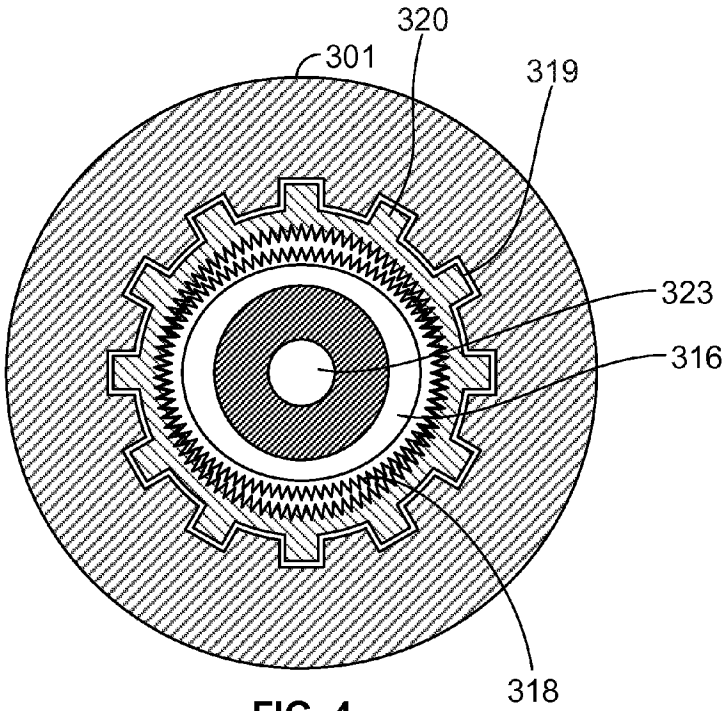
FIG. 4 is a cross-sectional top view of the harmonic drive transmission of FIG. 2.
Figure 3:
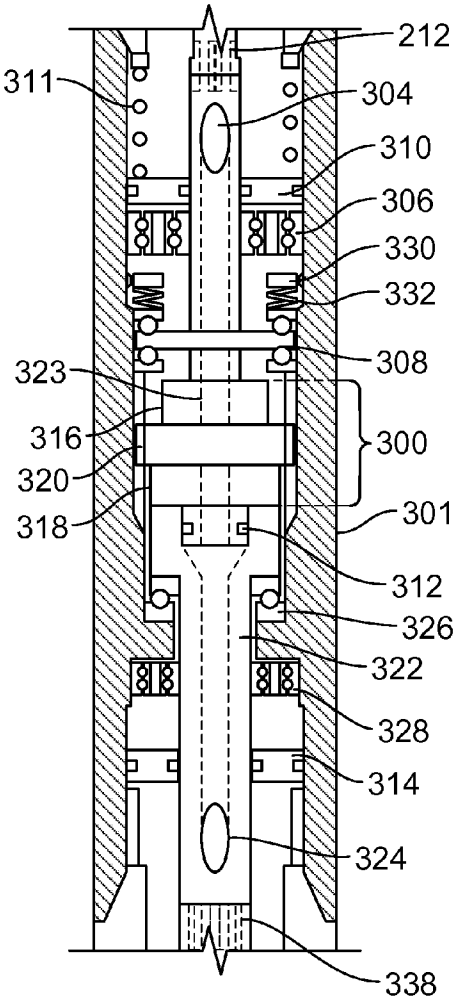
FIG. 3 is an enlarged side view of the harmonic drive transmission of FIG. 2.

FIG. 2 is a cross-sectional side view of an example bottom hole assembly 100 that can, for example, be incorporated in the drilling rig 10 depicted in FIG. 1. In this example, the bottom hole assembly 100 features a drilling motor 200 coupled to a harmonic drive transmission 300. The drilling motor 200, as noted above, is a turbine motor including a motor housing 202 defining a central bore receiving a motor shaft 204 fitted with a plurality of radially extending motor vanes 206. In this example, the motor vanes 206 are oriented so as to create a left hand rotation of the motor shaft 204 as drilling fluid is circulated (e.g., pumped) through the motor housing 202. In some other implementations, however, a right hand rotation of the motor shaft may be preferred. The motor shaft 204 is supported within the motor housing 202 by a pair of radial bearings 208 located at either end of the arrangement of motor vanes 206, and by an axial bearing 210 located below the motor vanes. The axial bearing 210 is braced at its upper race by a ridge of the motor housing 202 and at its lower race by a retainer section 102 coupling the motor housing 202 to a transmission housing 301.

Various radial and axial bearings are located throughout the bottom hole assembly 100 to support various rotating components by anchoring radial and axial loads to the stationary outer housing(s). In this example, many of the radial bearings are provided with through-holes (209) that permit passage of fluid (e.g., drilling fluid or lubricant oil) therethrough.

The motor shaft 204 extends through the retainer section 102 to connect with an input shaft 302 of the harmonic drive transmission 300 at a spline coupling 212. The spline coupling 212 acts as a torque transmission medium, causing the input shaft 302 to rotate with a high speed, low torque rotation characteristic that is substantially identical to the motor shaft 204.

Just below the spline coupling 212, the input shaft 302 defines a drilling fluid inlet 304 opening to a central bore of the input shaft. The drilling fluid inlet 304 is part of a diversion subsystem for isolating the drilling fluid from certain portions of the harmonic drive transmission 300 (e.g., the gear teeth of the wave generator, circular spline, and flexspline). The input shaft 302 is supported within the transmission housing 301 by a radial bearing 306 and an axial bearing 308.

A balance piston 310, loaded by a compensator spring 311, is located just below the drilling fluid inlet 304. In this example, the balance piston 310 is a dual purpose component, acting as a pressure balance device and an upper rotary seal. In its upper rotary seal function, the balance piston 310 rotary seals the area below the drilling fluid inlet 304 from ingress of drilling fluid that is not immediately diverted through the inlet. The balance piston 310 together with an inner rotary seal 312 and a lower rotary seal 314 create a sealed volume about the harmonic drive transmission 300. The sealed volume contains a lubricant oil to reduce friction between rotating components of the harmonic drive transmission 300.

The additional function of the balance piston 310 is to create a bias pressure on the contained lubricant oil, so as to encourage limited oil leakage (e.g., weeping), which continuously flushes away drilling fluid contaminants. This arrangement extends the "rotary seal life" of the sealing member, which may be susceptible to accelerated degradation due to its constant exposure to drilling fluid contaminants. In some examples, a rotary seal includes an end face mechanical seal or a "Type-W axial shaft" mechanical face seal of highly polished metal or ceramic (such as those manufactured by Daemar Inc.). In some examples, a rotary seal includes an elastomer type seal (such as those manufactured by Kalsi Engineering, e.g., the Kalsi "507 series wide footprint" seal).

The lower end of the input shaft 302 connects to a wave generator 316, such that the wave generator rotates with a high speed, low torque rotation substantially identical to the input shaft and the motor shaft 204. The shaft then extends through the harmonic drive unit to support one end of the inner rotary seal 312. The wave generator 316 includes an elliptical-shaped cam disk having a smooth outer edge bearing against the inner surface of a flexspline 318. In some examples, a radial ball bearing is located between the wave generator and the flexspline 318. The flexspline 318 is a shallow cup-shaped component with a thin, flexible outer wall and a substantially thick, rigid base. The flexible outer wall of the flexspline 318 fits tightly around the wave generator 316, so that the circular flexspline wall continuously deforms to a rotating elliptical shape as the wave generator rotates. The outer surface of the wave generator 316 and the inner surface of the flexspline 318 are smooth, which allows the wave generator to bear against the flexspline 318 without urging the flexspline to rotate with the wave generator. The outer surface of the flexspline's flexible wall defines a radial pattern of gear teeth meshing with the gear teeth of a supporting circular spline 320. The circular spline 320 is mounted in place (e.g., by splines 319 or suitable mounting hardware) to the transmission housing 301.

The flexspline 318 has fewer gear teeth and a smaller radius than the circular spline 320. Thus, deformation of the flexspline 318, due to rotation by the wave generator 316, causes some of the flexspline gear teeth to mesh with the teeth of the circular spline 320, while other flexspline gear teeth completely unmesh. In this manner, each full rotation of the wave generator 316 causes the flexspline 318 to "walk backward" around the stationary circular spline 320 at a rate proportional to the gear ratio of the transmission. Therefore, as compared to the wave generator 316, the flexspline 318 exhibits low speed, high torque rotation in an opposite direction (e.g., a right hand rotation if the motor shaft 204 is driven in a left hand rotation). The rigid base of the flexspline 318 is coupled to an output shaft 322 driven at a low speed, high torque rotation substantially identical to the flexspline 318. The preceding description pertains to a step down harmonic drive transmission, where the input shaft is coupled to the wave generator and the output shaft is coupled to the flexspline. To provide a step up harmonic drive transmission, the input shaft is coupled to the flexspline and the output shaft to the wave generator.

The gear ratio is represented by the following equations:

$$GR = \frac{(T_f - T_c)}{T_f} \tag{1}$$

$$GR^{-1} = \frac{T_f}{(T_f - T_c)} \tag{2}$$

where GR is gear ratio, $T_f$ is the number of teeth on the flex spline, and $T_c$ is the number of teeth on the circular spline. Equation (1) defines the gear ratio for a step down harmonic drive transmission. Equation (2) defines the gear ratio for a step up harmonic drive transmission.

The harmonic drive transmission 300 can be designed to provide a step up (or step down) gear ratio of a magnitude between about 10:1 (or 1:10) and 100:1 (or 1:100). In a particular example, the harmonic drive transmission 300 provides a gear ratio of 30:1. The harmonic drive transmission 300 is designed to provide 30× step down by employing a flexspline having 60 teeth and a circular spline have 62 teeth, creating a gear ratio of −1:30. Thus, for every full turn of the wave generator, the flexspline undergoes 0.033 turns in the opposite direction (or, for every 30 turns of the wave generator, the flexspline undergoes 1 full turn).

The transmission sub-assembly of the wave generator 316, flexspline 318, and circular spline 320 described above defines a central passageway 323 extending along a shared axis of rotation. The input shaft 302 projects through the central passageway 323 to couple with the output shaft 322. The rotary coupling between the input shaft 302 and the output shaft 322 permits each shaft to rotate independently, and allows the diverted flow of drilling fluid to pass directly from the central bore of the input shaft to the central bore of the output shaft 322, bypassing the wave generator 316, flexspline 318, and circular spline 320. The inner rotary seal 312 seals the coupling between the flexspline 318 and the output shaft 322 against egress of drilling fluid contaminants from the coupling to the sealed volume containing the lubricant oil. The output shaft 322 included a drilling fluid outlet 324 for ejecting the diverted flow of drilling fluid toward the drill bit at the lower end of the bottom hole assembly 100. The drilling fluid outlet 324 is located below the lower rotary seal 314. The output shaft 322 is supported by axial and radial bearings 326 and 328. Components of the above-described configuration cooperate to divert the flow of drilling fluid through the center of the transmission sub-assembly. This configuration may be advantageous compared to other workable arrangements (e.g., diverting to drilling fluid through an annulus around the outside of the transmissions sub-assembly) because it maximizes the limited radial space of the well bore, allowing for larger transmission sub-assembly components that can provide superior torsional strength and gear ratios.

A transmission locknut 330 cooperating with the axial bearing 308 supporting the input shaft 302 locks the rotating components of the harmonic drive transmission 300 in place axially within the transmission housing 301. A resilient member 332 (e.g., a bevel spring) is positioned between the locknut 330 and the axial bearing 308 to absorb and dampen vibrations.

The output shaft 322 extends through the transmission housing 301 to connect with an articulated extension rod 104 at a lower spline coupling 338. The spline coupling 338 transmits torque from the output shaft 322 to the extension rod 104, causing the extension rod to rotate with a low speed, high torque rotation characteristic substantially identical to the output shaft 322. The extension rod 104 is accommodated by a bent housing 106. The degree and direction of the bend exhibited by the bent housing 106 may be fixed, adjustable, or even remotely down hole adjustable. In addition the bent housing can be replaced with a straight housing, removing the need for the articulated extension rod, and extend the output shaft up to the lower spline connection. The output shaft can be connected to a drill bit or some other bottom hole assembly component such as a rotary steerable tool. The extension rod 104 is connected to a drive shaft 108 mounted to a lower housing 110 by axial and radial bearings 112 and 114. The lower end of the drive shaft 108 includes a coupling 116 for attaching a suitable drill bit (not shown).

As noted above, both of the input shaft 302 and the output shaft 322 of the harmonic drive transmission 300 are designed to create a detachable splined torsional coupling with other driving shafts (e.g., the motor shaft 204) and driven shafts (e.g., the extension rod 104). This configuration is particularly advantageous in that it allows the harmonic drive transmission 300 to be "stacked" with one or more other transmission stages for adjusting (e.g., stepping up or down) the speed of rotation based on drilling conditions (e.g., down hole conditions, earth formation, wellbore orientation) and equipment (e.g., drill bit type, motor type, etc.). Thus, various transmission modules can be added, removed, and/or replaced at the rig site to optimize the rotational speed and torque at the drill bit for the particular drilling application.

Various stacked configurations of harmonic drive transmission are contemplated by the present disclosure. In some examples, a stacked configuration can include multiple step down or step up harmonic drive transmissions. In some examples, a stacked configuration can include a step up and step down harmonic drive transmission positioned in sequence.

Figure 5A:
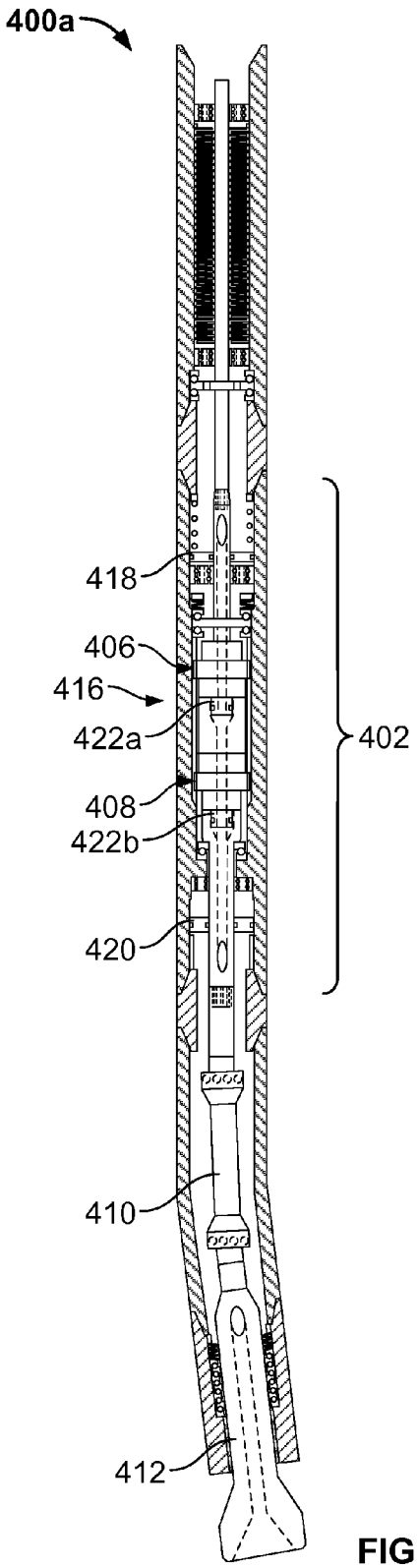
FIG. 5A is a schematic illustration of a first example bottom hole assembly featuring a multi-stage harmonic drive transmission sub-assembly.

FIG. 5A is a schematic illustration of a first example bottom hole assembly 400A featuring a multi-stage (or "stacked") transmission sub-assembly 402. The various components of the bottom hole assembly 400 are substantially similar to those of the bottom hole assembly 100 described in detail above. The bottom hole assembly 400 includes a drilling motor 404 supported in a wellbore by a drill string, and the multi-stage transmission sub-assembly 402. In this example, the transmission sub-assembly 402 includes a first harmonic drive transmission 406 and a second harmonic drive transmission 408. The first harmonic drive transmission 406 is coupled to the motor shaft of the drilling motor 404. The second harmonic drive transmission 408 is coupled to an output shaft of the first harmonic drive transmission 406. The output shaft of the second harmonic drive transmission 408 is coupled to an articulated extension rod 410, which connects to the drive shaft 412 for supporting the drill bit.

In this example, the transmission sub-assembly 402 is supported in a single transmission housing 416. Similar, to the previous example, the transmission housing 416 is fitted with an upper rotary seal 418 and a lower rotary seal 420. However, in this example, there are two inner rotary seals 422*a* and 422*b*. The inner rotary seal 422*a* is located at the coupling between the input shaft and the output shaft of the first harmonic drive transmission 406. The inner rotary seal 422*b* is located at the coupling between the input shaft and the output shaft of the second harmonic drive transmission 408. The inner rotary seals permit the flow of drilling fluid through the central bore of the transmission and the differential rotation between the two shafts while preventing ingress of drilling fluid into the lubricated volume of the transmission.

The first harmonic drive transmission 406 is a step down transmission, and the second harmonic drive transmission 408 is a step up transmission. This type of alternating step down/step up configuration may be advantageous, for example, if a desired gear ratio is difficult to achieve with a single stage harmonic drive transmission and/or if it is not cost effective to manufacture a new single stage harmonic drive transmission for a particular drilling application. In one example, the drilling motor 404 is designed to run at 3,000 RPM and the transmission sub-assembly 402 is configured to provide 500 RPM at the drill bit. In this example, the first harmonic drive transmission 406 includes a 360 tooth flexspline and 362 tooth circular spline, which produce a step down gear ratio of −1:180. The second harmonic drive transmission 408 includes a 62 tooth circular spline and 60 tooth flexspline, which produce a step up gear ratio of −30:1.

Figure 5B:
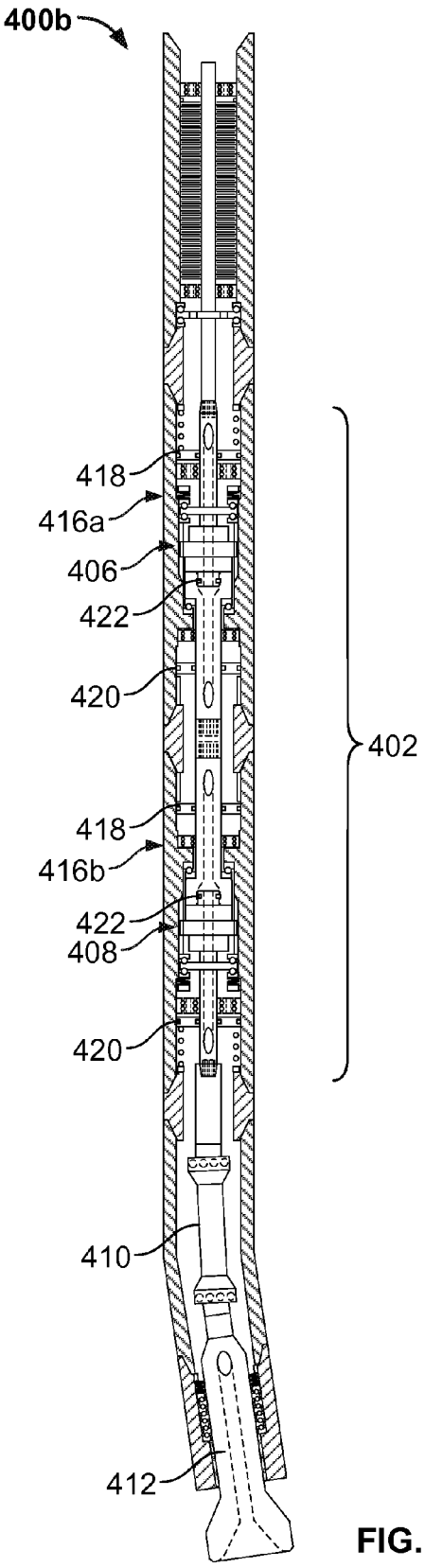
FIG. 5B is a schematic illustration of a second example bottom hole assembly featuring a multi-stage harmonic drive sub-assembly.

FIG. 5B is a schematic illustration of a second example bottom hole assembly 400B, which is similar to the bottom hole assembly 400A. In this example, however, the transmission assembly 402 is supported by two individual transmission housing 416*a* and 416*b*, with the first transmission housing 416*a* carrying the first harmonic drive transmission 406 and the second transmission housing 416*b* carrying the second harmonic dive transmission 408. The first and second harmonic drive transmissions 406, 408 are stacked in a multi-stage arrangement as described above. In this example, each respective transmission housing is fitted with a respective set of rotary seals, including an upper rotary seal 418, lower rotary seal 420, and inner rotary seal 422.

This schematic example is provided solely for illustrative purposes, and is not intended to limit the scope of any multi-stage transmission sub-assembly contemplated by the present disclosure. Thus, any number of harmonic drive transmissions may be "stacked" to achieve a desired rotational speed, torque output. Various stacked configurations of harmonic drive transmissions are contemplated by the present disclosure. In some examples, a stacked configuration can include multiple step down or step up harmonic drive transmissions. In some examples, a stacked configuration can include a step up and a step down harmonic drive transmission positioned in sequence, one after the other (e.g., as shown in FIGS. 5A and 5B). Such harmonic drive transmissions may be designed with similar or different gear ratios. Further, the harmonic drive transmission may be stacked with one or more other types of transmissions (e.g., a planetary gear transmission) without departing from the scope of the present disclosure.

A number of embodiments of the invention have been described. Nevertheless, it will be understood that various modifications may be made without departing from the spirit and scope of the inventions. For example, while the drilling assemblies set forth above have been described as implementing a down hole turbine motor, it is appreciated that any suitable type of down hole motor (e.g., an electric motor, a positive displacement motor, a hydraulic vane motor, etc.).

What is claimed is:

1. A drilling assembly positionable in a wellbore, the assembly including:

a turbine motor couplable to a drill string; and a harmonic drive transmission coupled to the turbine motor, the harmonic drive transmission comprising:

a circular spline;

a wave generator coupled to an input shaft;

a flexspline coupled to an output shaft;

a sealing subsystem including:

an upper rotary seal disposed around the input shaft;

a lower rotary seal disposed around the output shaft; and a drilling fluid diversion subsystem comprising a drilling fluid flow path including a drilling fluid inlet on the input shaft leading to a bore of the input shaft, and a drilling fluid outlet on the output shaft leading to a bore of the output shaft, the input shaft extending through a central opening defined by a central passage of the wave generator, a central passage of the flexspline, and a central passage of the circular spline to couple with the output shaft, such that the bore of the input shaft is in fluid communication with the bore of the output shaft.

2. The drilling assembly of claim 1, wherein the drilling fluid inlet is located above the upper rotary seal, and wherein the drilling fluid outlet is located below the lower rotary seal.

3. The drilling assembly of claim 1, wherein the wave generator comprises an elliptical cam disk having a smooth outer surface bearing against a flexible wall of the flexspline.

4. The drilling assembly of claim 1, wherein the flexspline comprises a substantially rigid base supporting a flexible wall, and wherein the output shaft is connected to the rigid base of the flexspline.

5. The drilling assembly of claim 1, wherein an outer surface of a flexible wall of the flexspline includes a radial pattern of gear teeth complementary to a radial pattern of gear teeth on an inner surface of the circular spline.

6. The drilling assembly of claim 5, wherein the flexspline includes less gear teeth than the circular spline.

7. The drilling assembly of claim 5, wherein an outer diameter of the circular spline is greater than an outer diameter of the flexspline.

8. The drilling assembly of claim 1, wherein the upper rotary seal comprises a spring-loaded balance piston.

9. The drilling assembly of claim 1, wherein the sealed volume contains lubricant oil.

10. The drilling assembly of claim 1, wherein the harmonic drive transmission comprises a first harmonic drive transmission, and wherein the drilling assembly further comprises a second harmonic drive transmission coupled to the first harmonic drive transmission.

11. The drilling assembly of claim 10, wherein the first harmonic drive transmission and the second harmonic drive transmission have different gear ratios.

12. The drilling assembly of claim 1, wherein the input shaft is coupled to a motor shaft of the turbine motor by a detachable spline coupling.

13. The drilling assembly of claim 1, wherein the output shaft is coupled to an articulated extension rod by a detachable spline coupling.

14. The drilling assembly of claim 1, wherein the sealing subsystem defines a substantially sealed volume containing the circular spline, wave generator, and flexspline, and isolates the circular spline, wave generator, and flexspline from drilling fluid exiting the turbine motor and flowing through the harmonic drive transmission.

15. A method conducting drilling operations in a wellbore, the method comprising:

attaching a turbine motor to a drill string;

coupling a harmonic drive transmission to the turbine motor, the harmonic drive transmission comprising:

a circular spline;

a wave generator coupled to an input shaft;

a flexspline coupled to an output shaft;

a sealing subsystem including:

an upper rotary seal disposed around the input shaft;

a lower rotary seal disposed around the output shaft;

a drilling fluid diversion subsystem comprising a drilling fluid flow path including a drilling fluid inlet on the input shaft leading to a bore of the input shaft; and a drilling fluid outlet on the output shaft leading to a bore of the output shaft, the input shaft extending through a central opening defined by a central passage of the wave generator, a central passage of the flexspline, and a central passage of the circular spline to couple with the output shaft, such that the bore of the input shaft is in fluid communication with the bore of the output shaft; and positioning the drill string and the turbine motor and the harmonic drive transmission in the well bore.

16. The method of claim 15, further comprising:

flowing drilling fluid down the drill string and through the turbine motor;

routing, with a drilling fluid diversion subsystem, drilling fluid from the turbine motor towards a lower end of the tool string; and inhibiting, with the sealing subsystem, drilling fluid flowing through the drilling fluid flow path from contacting the circular spline, wave generator, and flexspline.

17. The method of claim 16, wherein routing drilling fluid comprises:

flowing drilling fluid through the bore of the input shaft;

flowing drilling fluid passed the coupling between the input shaft and the output shaft; and flowing drilling fluid through the bore of the output shaft.

18. A drilling assembly positionable in a wellbore, the assembly including:

a turbine motor couplable to a drill string;

a first transmission coupled to the turbine motor, the first transmission comprising:

a circular spline;

a wave generator coupled to an input shaft; and a flexspline coupled to an output shaft;

a second transmission coupled to the first transmission; and a drilling fluid diversion subsystem configured to route drilling fluid from the turbine motor through a drilling fluid flow path including a drilling fluid inlet on the input shaft leading to a bore of the input shaft, and a drilling fluid outlet on the output shaft leading to a bore of the output shaft, the input shaft extending extending along a shared axis of the circular spline, wave generator, and flexspline of the first transmission to couple with the output shaft, such that the bore of the input shaft is in fluid communication with the bore of the output shaft.

19. The drilling assembly of claim 18, wherein the first transmission further comprises:

a sealing subsystem including:

an upper rotary seal disposed around the input shaft;

a lower rotary seal disposed around the output shaft; and an inner rotary seal located at a coupling between the input shaft and the output shaft.

20. The drilling assembly of claim 18, wherein the first and second transmissions are supported in a shared transmission housing.

21. The drilling assembly of claim 18, wherein the first and second transmissions are supported in separate transmission housings.

22. The method of claim 15, wherein the sealing subsystem defines a substantially sealed volume containing the circular spline, wave generator, and flexspline, and isolates the circular spline, wave generator, and flexspline from drilling fluid exiting the turbine motor and flowing through the harmonic drive transmission.

23. The drilling assembly of claim 19, wherein the sealing subsystem defines a substantially sealed volume containing the circular spline, wave generator, and flexspline, and isolates the circular spline, wave generator, and flexspline from drilling fluid exiting the turbine motor and flowing through the first transmission.

* * * * *